United States Patent [19]

Maisel

[11] 4,080,807

[45] Mar. 28, 1978

[54] NEEDLE BED ASSEMBLY INCORPORATING ARCUATELY SHAPED NEEDLES

[76] Inventor: Hans Maisel, Timesstrasse 5, D-8581 Mistelbach, Germany

[21] Appl. No.: 779,651

[22] Filed: Mar. 21, 1977

[30] Foreign Application Priority Data

Mar. 27, 1976 Germany ..... 2613179

[51] Int. Cl.[2] ..... D04B 23/04; D04B 23/02

[52] U.S. Cl. ..... 66/115; 66/64; 66/13

[58] Field of Search ..... 66/5, 115, 123, 60, 66/62, 64, 13, 92, 17–19

[56] References Cited

U.S. PATENT DOCUMENTS

| | | | |
|---|---|---|---|
| 709,841 | 9/1902 | Williams | 66/19 |
| 1,855,033 | 4/1932 | Spiers | 66/115 |

FOREIGN PATENT DOCUMENTS

| | | | |
|---|---|---|---|
| 815,931 | 5/1936 | France | 66/13 |
| 687,914 | 1/1940 | Germany | 66/17 |
| 490,311 | 2/1954 | Italy | 66/115 |
| 2,193 of | 6/1877 | United Kingdom | 66/123 |
| 3,008 of | 7/1880 | United Kingdom | 66/123 |
| 952,381 | 3/1964 | United Kingdom | 66/18 |

*Primary Examiner*—Mervin Stein
*Assistant Examiner*—Andrew M. Falik
*Attorney, Agent, or Firm*—Allison C. Collard

[57] ABSTRACT

A needle and needle bed assembly for flat and circular knitting machines for making right-right and left-left knitted articles, includes at least one horizontally-disposed needle bed having a generally concavely-shaped upper surface which has formed therein a plurality of transversely-extending, generally arcuately-shaped grooves, and a plurality of generally arcuately-shaped needles, each of which is slidably supported within one of the grooves of the bed for movement between a push-out position and a drawing-in position, in which positions one end of the needles extends beyond a lateral edge of the bed. The needles are guided in the grooves such that the angle defined between the ends of the needles, as measured by the tangent thereto, and the vertical axis of the bed, decreases as the needles are moved from the drawing-in position to the push-out position.

5 Claims, 1 Drawing Figure

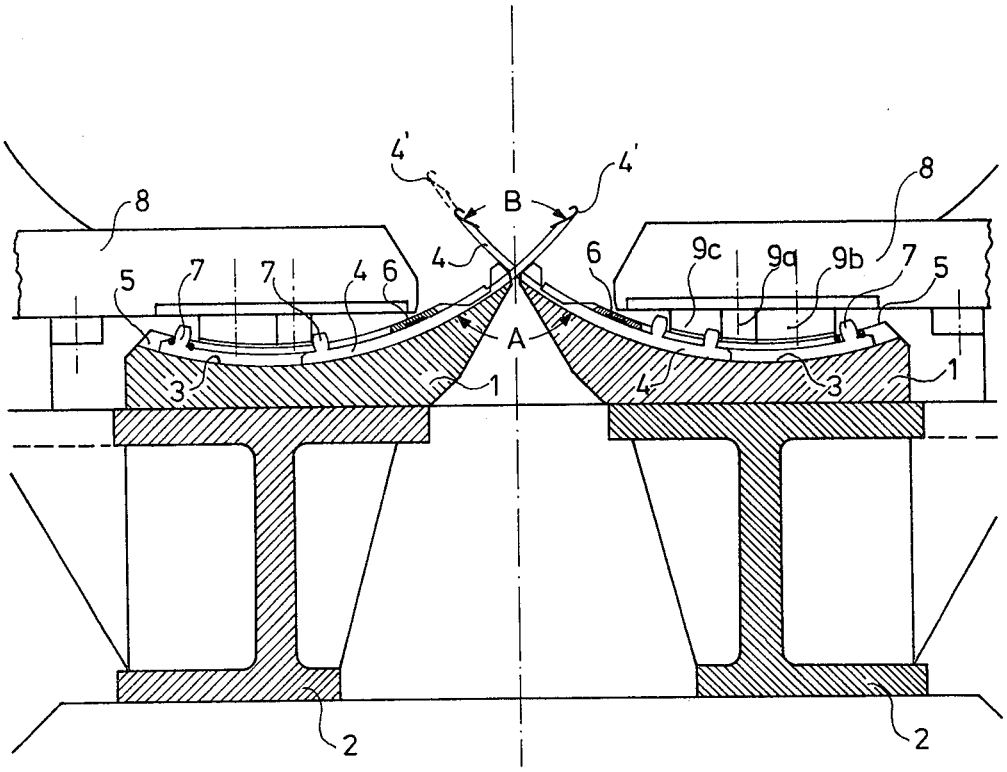
4'
4'
B
8
8
4
6
9c
9a
9b
7
5
5
7
7
4
6
A
3
1
4
3
1
2
2

NEEDLE BED ASSEMBLY INCORPORATING ARCUATELY SHAPED NEEDLES

This invention relates to a needle and needle bed assembly for flat and circular knitting machines having crossing needles for making right-right and left-left knitted goods.

In conventional flat and circular knitting machines having crossing needles which are suitable for making right-right knitted goods and take-up patterns with special left-left character, it has been necessary to reach a compromise with respect to the angular disposition of the needle supports or beds relative to one another. Typically, the needle beds are positioned roof-like with respect to each other at an angle of between 90° and 110°, with an angle of 90° being preferably used in circular knitting machines. However, it has been the desire to provide a needle and needle bed assembly wherein the angular disposition of the crossing needles may be varied. This is due to the fact that each knitting type requires different objects and working conditions. For example, in single bed knitting, the angle between the operating needle and the direction of the drawn off article should be rather small. In contrast, with two bed knitting, the needle angle should be rather large, so as to facilitate the sliding off of the loops (i.e., meshes) from the needle head; in order to obtain a less forceful loop or mesh knock over. For this purpose, a crossing angle of the needles of about 100° is used in most conventional flat knitting machines. The selection of this angle is a compromise which does not satisfy neither the one nor the other requirement in an optimum manner.

Accordingly, it is an object of the invention to provide a needle and needle bed assembly for straight and circular knitting machines with crossing needles which satisfy the different requirements in an optimum manner when making right-right and left-left knitted articles.

According to the present invention, there is provided a needle and needle bed assembly for flat and circular knitting machines for making right-right and left-left knitted articles comprising at least one horizontally disposed needle bed having a generally concavely shaped under surface which has formed therein a plurality of transversely extending, generally arcuately-shaped grooves, and a plurality of generally arcuately-shaped needles, each of which is slidably supported within one of the grooves of the at least one bed for movement between a push-out position and a drawing-in position, in which positions one end of the needles extends beyond a lateral edge of the bed, the needles being guided in the grooves such that the angle defined between the ends of the needles, as measured by the tangent thereto, and the vertical axis of the bed, decreases as the needles are moved from the drawn-in position to the push-out position.

Due to the arcuately-shaped needles which are guided in corresponding arcuately-shaped grooves, the needle angle with respect to the vertical axis, relative to the expelling degree of the needle, is constantly changed. In the push-out position, the needle angle is the smallest, i.e., the needle position is the steepest. With these new curved needles, it is possible to expand the drawing-in angle above 110°, whereby a lesser forceful knocking over loop or mesh is obtained. In single bed knitting, the sliding off of the loop from the needle tongue is improved, due to the steeper needle expelling angle of about 95°.

Other features of the present invention will become apparent from the following detailed description considered in connection with the accompanying drawing which discloses an embodiment of the invention. It is to be understood, however, that the drawing is designed for the purpose of illustration only and not as a definition of the limits of the invention.

The single drawing shows a sectional view of the novel needle and needle bed assembly embodying the present invention, employed in a flat knitting machine wherein two needle beds are positioned at the same horizontal plane.

As shown in the appended drawing, two needle beds 1 are provided which are not positioned roof-like with respect to one another, but rather are horizontally-disposed as in a left-left flat knitting machine. The beds 1 are positioned opposite each other at the same plane by means of a double T-shaped support 2. Each of the beds has a plurality of spaced arcuately-shaped ribs 5 which define therebetween arcuately-shaped needle-receiving grooves 3. An arcuately-shaped latch-needle 4 is slidably supported in each of the grooves 3 in such a manner that they can be pushed out and drawn in for knitting, cardigan and transfer between the needle bed ribs 5, in a known manner.

In the push-out position, angle B is about 95°. Therefore, needles are at 4′ in a steeper position than in the drawing-in position where the angle A is about 110° or more. Grooves 3 are covered in a known manner by needle cover rails 6 so that the latch-needles 4 cannot jump out of the grooves 3 during rapid movement.

Movable carriers or cam plates 8 are provided which include cam members *9a, 9b* and *9c* which are disposed for camming engagement with the butt 7 of needles 4. The butts 7 are barrel-shaped so that during the circular-like movements of needles 4 effected by operation of the cam plates 8, positive locking is provided at all times with the cam members *9a, 9b* and *9c*. To facilitate this positive locking action, the upwardly directed face of needles 4 and needle bed ribs 5 are provided with a generally concave-cylindrical shape and the downwardly directed surface of the cam members *9a, 9b* and *9c* has a correspondingly curved lower face; i.e., the downwardly directed surface of cam members *9a, 9b, 9c* is provided with a generally convex-cylindrical shape.

In contrast to the conventional roof-like arrangement of the needles and needle beds, the instant positioning and structure of the needles and needle bed assembly at the same horizontal plane has the further advantage that the take down rollers for the knitted material can be brought relatively near to an upward position which prevents a lateral constriction of the knitted material. It also reduces the lateral pull on needles 4 which are positioned at both sides of the knitted article. The horizontal arrangement of cam plates 8 also provides a better and more clear operation of the machine.

When the assembly is used in circular knitting machines, the same sectional view is presented with respect to the needle bed arrangement as shown in the drawing. The needle beds 1 are oppositely arranged in a horizontal plane with respect to each other, with the only difference being that the needle beds run around a common concentric axis, but with different radiuses, and that the associated cam members 9 move circularly around the concentric axis.

While only a single embodiment of the present invention has been shown and described, it will be obvious to those skilled in the art that many changes and modifications may be made thereto without departing from the spirit and scope of the invention.

What is claimed is:

1. A needle and needle bed assembly for flat and circular knitting machines for making right-right and left-left knitted articles comprising:

at least one horizontally-disposed needle bed having a generally concavely-shaped upper surface which has formed therein a plurality of transversely-extending, generally arcuately-shaped grooves; and a plurality of generally arcuately-shaped needles, each of which is slidably supported within one of said grooves of said at least one bed for movement between a push-out position and a drawing-in position, in which positions one end of said needles extends beyond a lateral edge of said bed, said needles being guided in said grooves such that the angle defined between the ends of said needles, as measured by the tangent thereto, and the vertical axis of said bed, decreases as said needles are moved from said drawing-in position to said push-out position, said angle of said end of said needles in the push-out position being about 47½° and in the drawing-in position about 55°, relative to the vertical.

2. The assembly as recited in claim 1 additionally comprising means for reciprocally moving said needles between said push-out and said drawing-in positions.

3. The assembly as recited in claim 2, wherein each of said needles has a concavely-shaped upper surface from which upwardly extends a barrel-shaped butt member and wherein said reciprocating means includes at least one cam plate mounted above said bed which includes a plurality of cam members, each of which has a generally convexly-shaped lower surface which is disposed for camming engagement with said barrel-shaped butt members of each of said needles.

4. A needle and needle bed assembly for flat and circular knitting machines for making right-right and left-left knitted articles comprising:

a pair of horizontally-disposed needle beds, each of which has a generally concavely-shaped upper surface having formed therein a plurality of transversly-extending, generally arcuately-shaped grooves, with the grooves of one bed being transversly offset in relation to the grooves of the other bed, said beds being disposed adjacent one another and positioned at the same horizontal plane;

a plurality of generally arcuately-shaped needles, each of which is slidably supported within one of the grooves of each of said beds for movement between a push-out position and a drawing-in position in which positions the needles mounted on said one bed cross between the needles mounted on said other bed, said needles being guided in said beds such that the angle of the end of the needle back, defined between the crossing ends thereof, as measured by the tangents thereto, decreases as said needles are moved from said drawing-in position to said push-out position.

5. The assembly as recited in claim 4, wherein said angle of said needle ends is about 95° in said push-out position and about 110° in said drawing-in position.

* * * * *